US005354969A

United States Patent [19]

Akiyama et al.

[11] Patent Number: 5,354,969

[45] Date of Patent: Oct. 11, 1994

[54] POSITIVE-TEMPERATURE-COEFFICIENT THERMISTOR HEATING DEVICE AND PROCESS FOR PRODUCTION OF THE SAME

[75] Inventors: Yosinori Akiyama; Akio Nara, both of Okazaki; Hidetaka Hayashi; Yasuhiro Oya, both of Nagoya; Keiichi Yamada, Toyoake; Yasuaki Tsujimura, Okazaki, all of Japan

[73] Assignee: Nippondenso Co., Ltd., Kariya, Japan

[21] Appl. No.: 60,939

[22] Filed: May 13, 1993

[30] Foreign Application Priority Data

May 15, 1992 [JP] Japan ..... 4-148512
Apr. 2, 1993 [JP] Japan ..... 5-076758

[51] Int. Cl.[5] ..... H05B 3/08

[52] U.S. Cl. ..... 219/541; 219/505; 219/540

[58] Field of Search ..... 219/540, 541, 504, 505; 338/22 R, 225 D, 23; 156/273.7, 273.9, 274.8, 275.5, 275.7, 307.3, 307.7

[56] References Cited

U.S. PATENT DOCUMENTS

| | | | |
|---|---|---|---|
| 3,748,439 | 7/1973 | Ting et al. | 219/540 |
| 4,032,752 | 6/1977 | Ohmura et al. | 219/541 |
| 4,053,864 | 10/1977 | Rodriguez et al. | 338/225 D |
| 4,368,380 | 1/1983 | Igashira et al. | 219/541 |
| 4,414,052 | 11/1983 | Habata et al. | 156/273.7 |
| 4,482,801 | 11/1984 | Habata et al. | 219/540 |
| 4,588,456 | 5/1986 | Dery et al. | 156/295 |
| 5,192,853 | 3/1993 | Yeh | 219/540 |
| 5,235,741 | 8/1993 | Mase | 156/275.7 |

FOREIGN PATENT DOCUMENTS

| | | | |
|---|---|---|---|
| 2639370 | 3/1977 | Fed. Rep. of Germany . | |
| 3707505 | 9/1987 | Fed. Rep. of Germany . | |
| 3900787 | 7/1990 | Fed. Rep. of Germany . | |
| 2165943 | 8/1973 | France . | |
| 3-261089 | 11/1991 | Japan | 219/540 |
| 44713 | 1/1992 | Japan . | |
| 4-91446 | 3/1992 | Japan | 156/295 |
| 2015250 | 9/1979 | United Kingdom . | |
| 2090710 | 7/1982 | United Kingdom . | |
| 2228653 | 8/1990 | United Kingdom . | |

OTHER PUBLICATIONS

Patent Abstract of Japan, vol. 14. No. 406, (C0754), Jun. 1990, re JP-A 2153868.

Dovbnya et al, DATABASE WPI, Aug. 1988, Re SU-A 1 415233.

*Primary Examiner*—Geoffrey S. Evans

*Attorney, Agent, or Firm*—Cushman, Darby & Cushman

[57] ABSTRACT

A positive-temperature-coefficient thermistor heating device including of a PTC element, a first electrode formed on its surface, a heat radiating means having heat radiating fins and a second electrode, and conductive particles contained in the first electrode and electrically conductive with the second electrode, and, also, a process for production of a positive-temperature-coefficient thermistor heating device including the steps of printing an electrode material paste containing conductive particles on the surface of a PTC element, heating this to bake it on and form a first electrode having a rough surface, and bringing the first electrode and the second electrode of the heat radiating means into contact by the conductive particles.

7 Claims, 8 Drawing Sheets

POSITIVE-TEMPERATURE-COEFFICIENT THERMISTOR HEATING DEVICE AND PROCESS FOR PRODUCTION OF THE SAME

BACKGROUND OF THE INVENTION

1. Field of the Invention

The present invention relates to a positive-temperature-coefficient thermistor heating device and a process for the production of the same.

2. Description of the Related Art

A positive-temperature-coefficient thermistor heating device of the related art, as shown in FIG. 6 and FIG. 7, was composed of a positive-temperature-coefficient element (PTC element) 91, a first electrode 8 formed on a planar manner (or in the form of a plane) on the two surfaces of the same, and a heat radiating means 93 having heat radiating fins 931 and a second electrode 932.

The PTC element 91 is made to emit heat by flowing a current between a heat radiating means 93, 93 provided on the two sides of the PTC element 91. The heat emitted by the PTC element 91 is radiated from the heat radiating fins 931 of the heat radiating means 93 through the first electrode 8 and second electrode 932, so this is used as a type of heater.

The above-mentioned applied current, as shown in FIG. 7, flows to the PTC element 91 only through the projections 81 of the first electrode 8 in contact with the second electrode 931.

Further, the first electrode 8 has a rough surface. This is because it is necessary, as mentioned above, to pass the above current between the first electrode 8 and the second electrode 932 and to bond the two by an electrically insulative adhesive 7. That is, electric conduction is obtained at the projections 81 of the rough surface, while the electrically insulative adhesive 7 is interposed in the depressions 83.

In the prior art, to form the first electrode 8 having the rough surface, there was proposed a process for flame spraying aluminum (Al) for formation of the first electrode on the surface of the PTC element 91 (Japanese Examined Patent Publication No. 4-4713).

There were the following problems, however, in the case of use of the above flame spraying process.

That is, the above Al flame spraying process does not give sufficient bonding to the surface of the PTC element 91. Therefore, it was necessary to perform pretreatment to roughen the surface of the PTC element in advance.

Further, even if trying to form a rough surface by flame spraying, the height of the projections would not become uniform.

Therefore, it was difficult to adjust the balance of the ratio of the projections 81 for application of current and the depressions 83 for interposition of the electrically insulative adhesive 7. As a result, the bonding was sufficient, but the conduction would be insufficient and the thermal output would be lowered, or conversely the thermal output would be large, but the bonding would be insufficient and therefore there would be peeling or detachment of the heat radiating means 93 from the PTC element 91.

Further, the work of flame spraying Al resulted in Al dust circulating in the workplace and therefore there was a danger to safety and sanitation and further a risk of accidents such as dust explosions.

SUMMARY OF THE INVENTION

The present invention, in consideration of the above problems in the prior art, provides a positive-temperature-coefficient thermistor heating device composed of a PTC element having electrodes with excellent conductive characteristics and a process for production of the same.

In accordance with the present invention, there is provided a positive-temperature-coefficient thermistor heating device composed of a PTC element, a first electrode formed on its surface, a heat radiating means having heat radiating fins and a second electrode, and conductive particles contained in the first electrode and electrically conductive with the second electrode.

In accordance with the present invention, there is also provided a process for production of a positive-temperature-coefficient thermistor heating device composed of the steps of printing an electrode material paste containing conductive particles on the surface of a PTC element, heating this to bake it on and form a first electrode having a rough surface, and bringing the first electrode and the second electrode of the heat radiating means into contact by the conductive particles.

BRIEF DESCRIPTION OF THE DRAWINGS

The present invention will be better understood from the description set forth below with reference to the accompanying drawings, wherein.

DESCRIPTION OF THE PREFERRED EMBODIMENTS

Figure 1:
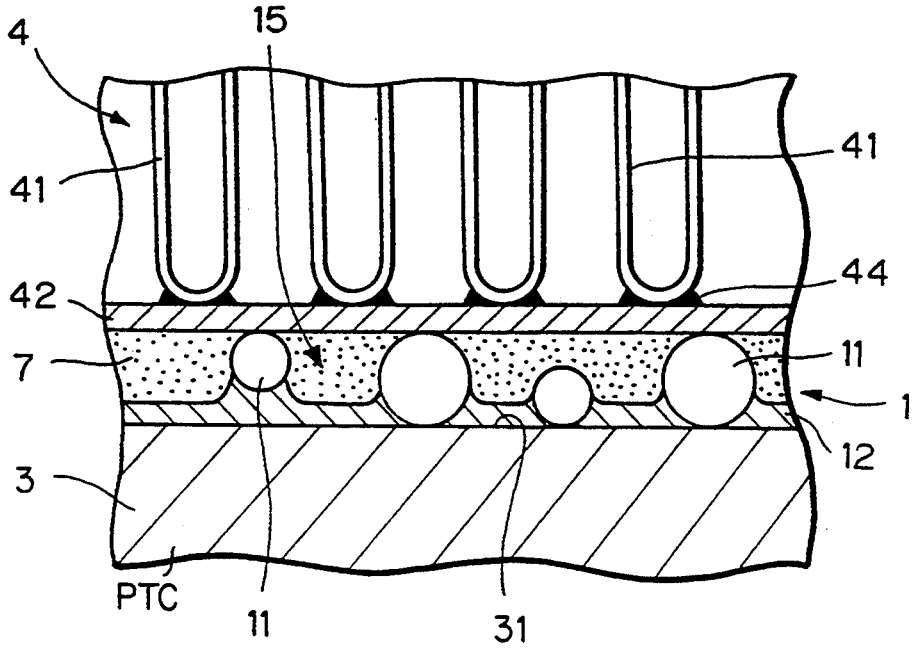
FIG. 1 is an enlarged sectional view of key portions of a positive-temperature-coefficient thermistor heating device of Example 1.

In the present invention, the first electrode is made to contain conductive particles, so is given a rough surface. Also, the conductive particles contact the second electrode.

As the conductive particles, use may be made of particles of an Al—Si alloy, Cu alloy, Ag alloy, etc., but as mentioned later, these are not particularly limited.

Further, the size of the conductive particles is preferably 30 to 150 $\mu$m. This enables the surface roughness of the irregular surface to be made 20 to 120 μm and enables a much more superior bonding force and thermal output to be exhibited.

The conductive particles are intermixed in the first electrode. That is, the first electrode is comprised of a matrix for formation on the surface of the PTC element in a planar manner and the above conductive particles. As the matrix, for example, use is made mainly of Al, Ag, etc. to which in added glass-like substances.

The conductive particles project out to the second electrode side from inside the substantially planar matrix in the first electrode. This forms the rough surface mentioned above.

The greater the content of the conductive particles in the first electrode, the better the amount of current and heat transfer between the first electrode and the second electrode. On the other hand, however, the amount of the electrically insulative adhesive between the rough surface and the second electrode becomes less and there is a danger of the bonding force between the two falling. Therefore, the conductive particles are preferably included in an amount of 4 to 50% by weight in the first electrode.

Further, the second electrode contacts the top surface of the conductive particles. Also, in the space between the second electrode and the first electrode, the electrically insulative adhesive is interposed and bonds the both. As the electrically insulative adhesive, use is made of silicone, epoxy, etc.

Further, the surface roughness of the rough surface is preferably 20 to 120 μm. This improves the bonding force between the first electrode and the second electrode much more and results in a small current resistance and heat conduction resistance between the both, so that the thermal output is improved much more (see FIG. 5).

Next, as the process for production of the positive-temperature-coefficient thermistor heating device, there is the process of production of a positive-temperature-coefficient thermistor heating device characterized by printing an electrode material paste including conductive particles on the surface of the PTC element, heating it to bake it on and form a first electrode having a rough surface, then bringing the first electrode and the second electrode of the heat radiating means into contact by the conductive particles.

The above-mentioned electrode material paste is a viscous inky substance composed of the above-mentioned conductive particles, the matrix forming material, and a binder. As the matrix forming material, use is made of a mixture of particulate of aluminum, silver, or other metals and glassy low temperature substances for affixing the same. As the binder, there is ethyl cellulose and other organic binders. The organic binder is burned away during the above heating and baking step.

Here, especially in the case of a paste composed of aluminum, the aluminum particulates in the aluminum paste are oxidized during the electrode baking process and so the surface resistance of the electrode becomes considerably higher. Therefore, to prevent oxidation of the aluminum particulates, an aluminum paste with glass frit composed of mainly lead borosilicate is preferable.

Further, it is preferable to add from 4 to 50% by weight of the above-mentioned low resistance particles to the aluminum paste.

Also, it is preferable that the low resistance particles have a specific resistance of 100 μΩcm or less.

Electrode material paste is printed by, for example, screen printing, to a paste thickness of 5 to 50 μm. The heating and sintering are performed at a temperature at which the above-mentioned organic binder is burned away and the above-mentioned matrix formation material is baked to the surface of the PTC element together with the conductive particles.

A first electrode with a rough surface is formed on the above surface of the PTC element, then an electrically insulative adhesive is interposed between the irregular surface and the second electrode, the second electrode is made to contact the conductive particles, and the first electrode and the second electrode are bonded together.

With the positive-temperature-coefficient thermistor heating device of the present invention, it is possible to provide a positive-temperature-coefficient thermistor heating device composed of a PTC element having electrodes with excellent conductivity and a process for the production of thereof.

The rough surface of the first electrode is formed by the conductive particles, and the conductive particles and the second electrode are brought into contact.

Therefore, the current applied to the PTC element flows through the second electrode and the conductive particles (FIG. 1). Further, the heat generated by the PTC element flows through the conductive particles and the second electrode to the heat radiating means.

On the other hand, the first electrode and the second electrode are bonded by an electrically insulative adhesive at areas other than areas where the conductive particles contact the second electrode.

Further, in the present invention, the rough surface is formed by the conductive particles, so by adjusting the size and content of the conductive particles in the first electrode, it is possible to form any desired roughness of the rough surface.

Also, since use is made of conductive particles, it is possible to form a rough surface with a uniform height in accordance with the particle size.

Therefore, as mentioned earlier, it is possible to easily and reliably adjust the balance between the current and heat conduction portions (conductive particles) and the bonded portions (portions with electrically insulative adhesive). As a result, it is possible to obtain a positive-temperature-coefficient thermistor heating device with superior bonding force and thermal output.

Further, in producing the above positive-temperature-coefficient thermistor heating device, when using the above-mentioned paste printing method, there is no spraying of the conductive particles or the Al or other matrix forming materials as with the case of the conventional flame spraying method. Therefore, there is no danger of an accident.

Therefore, according to the present invention, it is possible to provide a positive-temperature-coefficient thermistor heating device which exhibits a large thermal output and is safe in production and a process for the production of the same.

Still further, in the present invention, the first electrode has added to it conductive particles and also glass frit composed mainly of lead borosilicate.

By adding the glass frit, the minute glass frit particles existing in the first electrode cover the area around the conductive particles, so it is possible to suppress oxidation of the conductive particles.

As explained above, in the present invention, it is possible to provide a positive-temperature-coefficient thermistor heating device comprised of a PTC element with electrodes having excellent conductivity and a process for production of the same.

EXAMPLES

The present invention will now be further illustrated by, but is by no means limited to, the following Examples.

Example 1

First, a positive-temperature-coefficient thermistor heating device according to an embodiment of the present invention will be explained using FIG. 1 to FIG. 4.

The positive-temperature-coefficient thermistor heating device 1 of this Example is composed of a PTC element 3, a first electrode 1 formed in a planar manner on the surface 31, and a heat radiating means 4 having heat radiating fins 41 and a second electrode 42. The first electrode 1 and the second electrode 42 are electrically connected.

Further, the first electrode 1 contains conductive metal particles 11 and has a rough surface 15 formed by the metal particles 11. The metal particles 11 almost all are in contact with the second electrode 42 and the first electrode 1 and the second electrode 42 are bonded by the electrically insulative adhesive 7 (FIG. 1).

Figure 3:
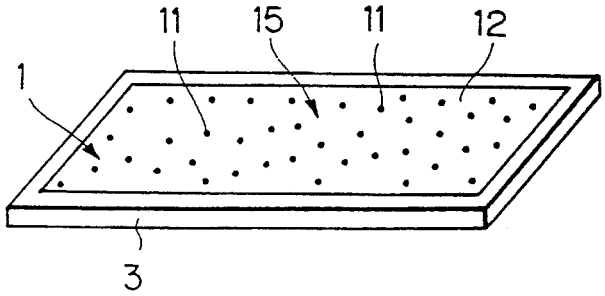
FIG. 3 is a perspective view of the PTC element and first electrode in Example 1.

The first electrode 1, as shown in FIG. 1 and FIG. 3, is formed on the top and bottom surfaces of the PTC element 3 and is composed of the metal particles 11 and a matrix 12. The matrix 12, as shown in Example 2, is composed, for example, of Al baked on the surface of the PTC element 3.

Figure 2:
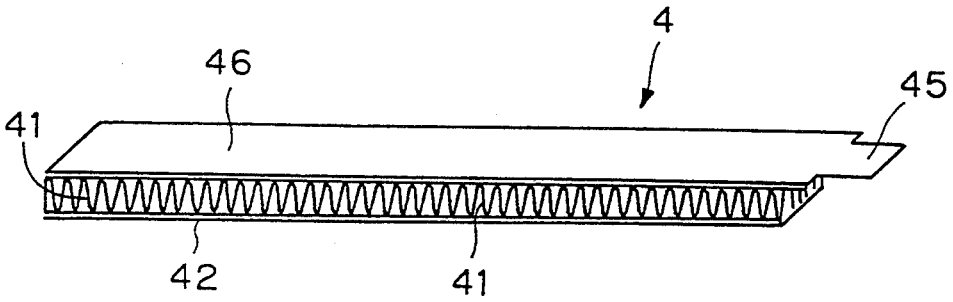
FIG. 2 is a perspective view of the heat radiating means in Example 1.

On the other hand, the heat radiating means, as shown in FIG. 1 and FIG. 2, is composed of the heat radiating fins 41, the second electrode 42 bonded by soldering 44 to one surface, and a surface metal plate 46 similarly bonded to the opposite side as the second electrode 42. The surface metal plate 46 has a terminal 45.

Figure 4:
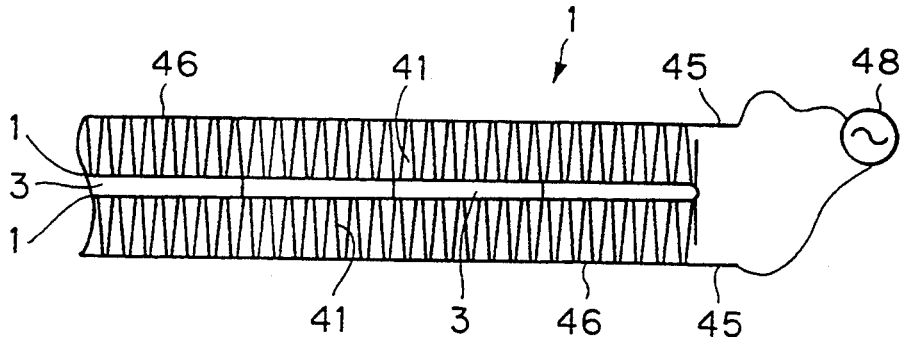
FIG. 4 is a side view of a positive-temperature-coefficient thermistor heating device in Example 1.

The above heat radiating means 4, as shown in FIG. 4, is bonded to the above PTC element 3 on its two sides. The terminals 45 of the heat radiating means 4 are connected to the power source 48.

Next, an explanation will be made of the mode of operation and effects.

In the positive-temperature-coefficient thermistor heating device of this Example, as shown in FIG. 1, the first electrode 1 has a rough surface 15 due to the inclusion of conductive metal particles 11, which metal particles 11 are in contact with the second electrode 42.

Therefore, the current applied to the PTC element 3 flows through the second electrode 42 and the metal particles 11. Further, the heat generated by the PTC element 3 flows to the heat radiating fins 42 through the metal particles 11 and the second electrode 42.

Further, the first electrode 1 and the second electrode 42, except at the portions of contact of the metal particles 11 and the second electrode 42, are strongly bonded by an electrically insulative adhesive 7.

Also, since the rough surface is formed by the metal particles 1, by adjusting the size and content of the metal particles 11, any surface roughness may be formed. Further, it is possible to form a rough surface with a uniform height in accordance with the size of the metal particles 11.

Therefore, it is possible to easily and reliably adjust the balance between the applied current and heat conduction portion and the bonded portions. As a result, it is possible to obtain a positive-temperature-coefficient thermistor heating device superior in both the bonding force and the thermal output.

Further, in the production of the positive-temperature-coefficient thermistor heating device, since use is not made of the flame spraying method used in the prior art, there is no danger of an accident.

Example 2

A more specific example of the positive-temperature-coefficient thermistor heating device shown in Example 1 will be explained next along with an example of its production.

In the positive-temperature-coefficient thermistor heating device of the present Example, the heat radiating fins 41 and the second electrode 42 are composed by aluminum, which has a high heat conductivity. The PTC element 3 uses PTC ceramic. Use is made of Al for the matrix 12 of the first electrode 1 and use is made of Al 85%–Si 15% (weight) alloy powder as the metal particles 11. As the electrically insulative adhesive 7, use is made of silicone.

Next, in the production of the above positive-temperature-coefficient thermistor heating device, first a first electrode 1 is formed on the surface of the PTC element 3.

In forming the first electrode 1, first 25% by volume of the above-mentioned Al—Si alloy powder used as metal particles of a size of about 100 μm, 40% by weight of Al powder of a size of 1 to 2 μm, and 35% by weight of solvent and organic binder are mixed.

By this, an electrode material paste containing metal particles is prepared. Note that as the above organic binder, use was made of ethyl cellulose.

Next, the electrode material paste is screen printed to the two surfaces of the PTC element 3. Then, the Al paste is dried, then heated under conditions of 700° C. to 900° C. and baked to the surfaces of the PTC element 3.

By this, as shown in FIG. 1, a first electrode 1 is obtained which has a matrix comprised of Al melt-bonded in a planar form on the surfaces of the PTC element 3 and has a rough surface 15 formed by protruding metal particles 11.

Note that at the time of baking, the above solvent and organic binder are burned away.

The above rough surface 15 has a roughness of about 70 μm since the size of the metal particles 11 is about 100 μm. The roughness is expressed by the point average roughness (Rz) defined by JIS (i.e., Japanese Industrial Standards) B0601-1982.

Next, an electrically insulative adhesive 7 is coated on the surface of the first electrode 1. The second electrode 42 of the heat radiating means is made to face and laminate the first electrode 1 on the two sides of the PTC element 3. The two are clamped under conditions of 150° C. to 250° C. By this, the above positive-temperature-coefficient thermistor heating device is obtained.

Example 3

Figure 5:
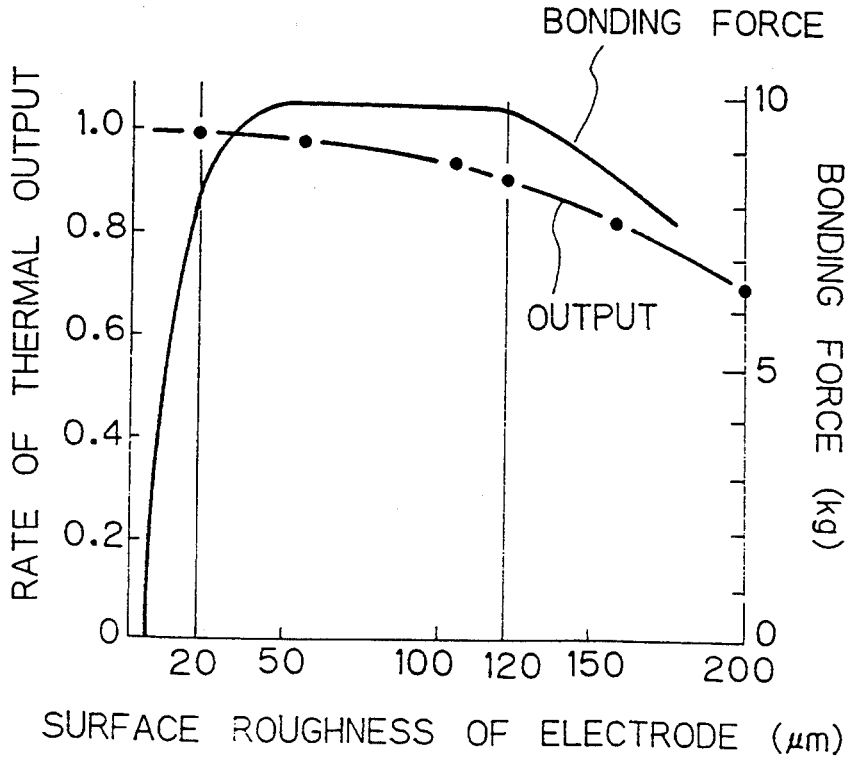
FIG. 5 is a graph showing the results of measurement in Example 3.
Figure 6:
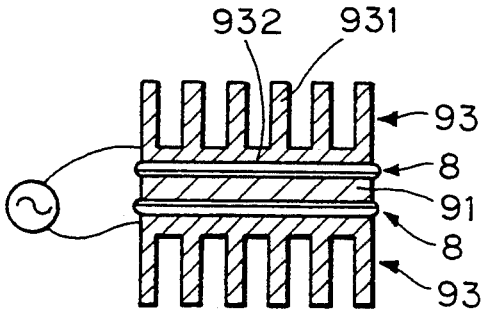
Fig. 6 ( PRIOR ART )
FIG. 6 is an explanatory view of the positive-temperature-coefficient thermistor heating device of the prior art.
Figure 7:
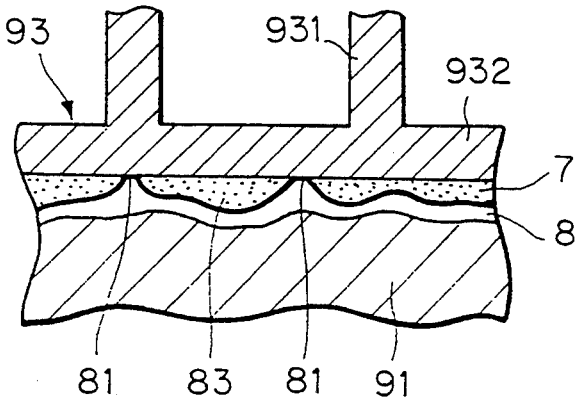
Fig. 7 ( PRIOR ART )
FIG. 7 is an enlarged view of key portions of a positive-temperature-coefficient thermistor heating device of the prior art.

Next, for the positive-temperature-coefficient thermistor heating device shown in Examples 1 and 2, as shown in FIG. 5, the roughness of the rough surface of the first electrode was changed in various ways and the thermal output to the heat radiating means and the bonding force by the electrically insulative adhesive were measured.

The above surface roughness was a value in the state before the bonding of the second electrode, as shown in Example 2, that is, the value after baking in of the electrode material paste. When the surface roughness is zero, that is, when the first electrode has an even surface, the thermal output when the first electrode and the second electrode are brought into complete facial contact is made 1.0.

As will be understood from the Figure, the thermal output gradually falls as the surface roughness becomes greater. On the other hand, the bonding force increases sharply up to a surface roughness of 50 μm or so, remains substantially the same high value between 50 to 120 μm, and declines over 120 μm.

Therefore, considering both the thermal output and bonding force, it is learned that it is preferable that the roughness of the rough surface of the first electrode be 20 to 120 μm.

Example 4

Next, an explanation will be given of another Example of the present invention using the drawings.

In this Example, the explanation will be made of the case of application of the present invention to a PTC thermistor device.

Figure 8:
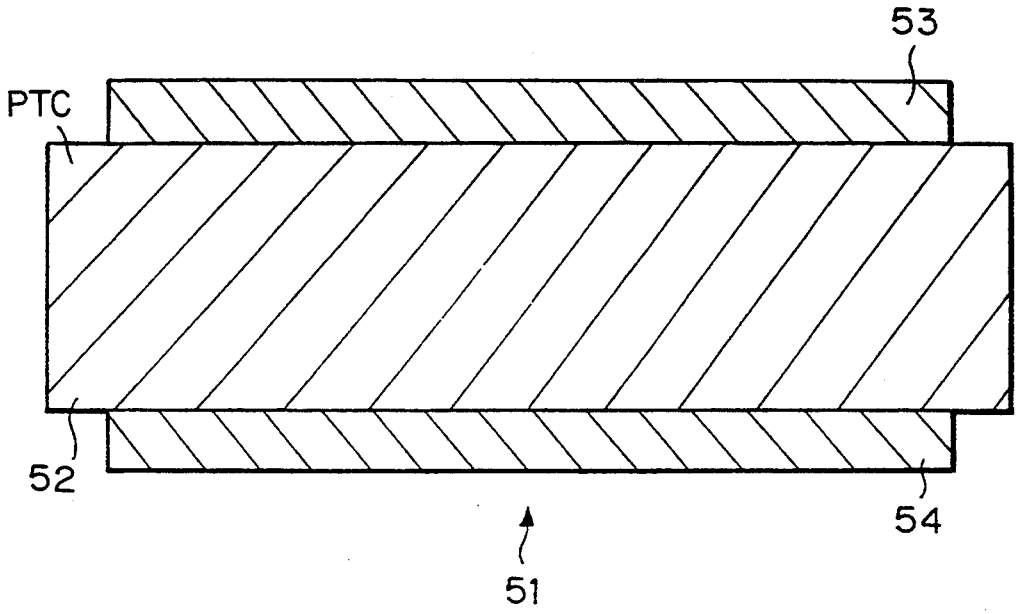
FIG. 8 is a constitutional view of Example 4 of the present invention.

FIG. 8 is a constitutional view of Example 4 of the present invention.

In FIG. 8, the PTC thermistor device 51 is comprised of a PTC ceramic element 52 formed from barium titanate on whose are provided in an opposing manner the electrodes 53 and 54 composed of aluminum paste with metal particles added.

The electrodes 53 and 54 will be explained in more detail here.

The electrodes 53 and 54 are composed of 85 g of a solid composed of aluminum powder to which has been added lead borosilicate glass frit and 15 g of Al—Si particles of a size of 10 to 25 μm, corresponding to low resistance particles, added thereto (15% by weight of paste solid content, specific resistance of 6.35 μΩcm). A binder (ethyl cellulose, PVA, etc.) and a solvent (n-butyl carbitol acetate etc.) are added and mixed in and then kneaded well to make a paste. The paste was coated on the two surfaces of a sintered PTC ceramic element 52 of 25 mm×25 mm×3 mm. This was dried at 150° C., then was held at 700° C. to 900° C. for about 20 minutes for baking to form the electrodes. At this time, the thickness of the electrodes after baking was 30 μm. The surface resistance of the thus prepared PTC thermistor device 51 was a good surface resistance of 0.020 Ω when measured by the twoterminal method at a width of 20 mm.

Example 5

Next, as Example 5, the optimum amount of addition of the Al—Si particles to the electrodes of the present invention was investigated. That is, the amount of addition of the Al—Si forming the electrodes 53 and 54 was changed from 0 to 60% by weight and the same process was performed as in the above-mentioned process. The surface resistance of the PTC thermistor device 51 was measured by the two-terminal method at a width of 20 mm. The results are shown in Table 1 and FIG. 9.

TABLE 1

| | No. | Material | Amount added (wt %) | Surface resistance (Ω) | Judgment | Specific resistance (μΩ cm) |
|---|---|---|---|---|---|---|
| Ex. 4 | 1 | Al-Si | 15 | 0.020 | ∘ | 6.35 |

TABLE 1-continued

| | No. | Material | Amount added (wt %) | Surface resistance (Ω) | Judgment | Specific resistance (μΩ cm) |
|---|---|---|---|---|---|---|
| Ex. 5 | 2 | Al-Si | 0 | 0.039 | x | 6.35 |
| | 3 | Al-Si | 2 | 0.028 | x | 6.35 |
| | 4 | Al-Si | 4 | 0.022 | ∘ | 6.35 |
| | 5 | Al-Si | 10 | 0.021 | ∘ | 6.35 |
| | 6 | Al-Si | 20 | 0.019 | ∘ | 6.35 |
| | 7 | Al-Si | 30 | 0.019 | ∘ | 6.35 |
| | 8 | Al-Si | 40 | 0.019 | ∘ | 6.35 |
| | 9 | Al-Si | 50 | 0.021 | ∘ | 6.35 |
| | 10 | Al-Si | 60 | 0.028 | x | 6.35 |

Figure 9:
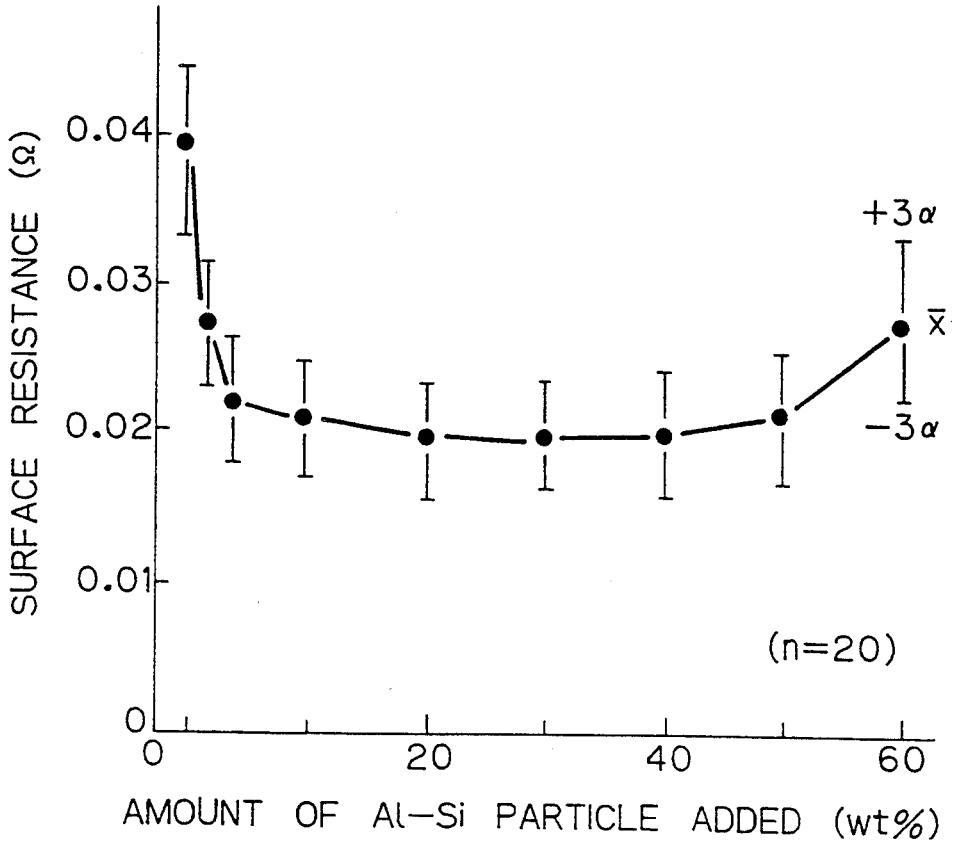
FIG. 9 is a characteristic diagram showing the changes in the surface resistance with respect to the changes in the amount of the Al—Si particles added.

FIG. 9 shows the changes in the surface resistance with respect to changes in the amount of Al—Si particles added.

As shown in FIG. 9, the surface resistance exhibits a decline in the surface resistance in the case of 0 to 30% by weight of Al—Si particles added.

This is believed to be due to the fact that, when the electrode baking is performed for forming the ohmic electrodes, the minute glass frit particles mainly comprised of lead borosilicate cover the Al—Si particles and suppress oxidation of the Al—Si particles. That is, since electrode baking is possible with the Al—Si particles in the low resistance state, the surface resistance can be reduced. Therefore, if the amount of the Al—Si particles added is from 0 to 30% by weight, by increasing the amount added, it is possible to reduce the resistance of the electrode surface.

However, when the amount added exceeds 50% by weight, a characteristic is shown of the surface resistance increasing. This is because if too much Al—Si particles are added, inevitably the relative amount of the glass frit and the Al—Si particles changes and the glass frit can no longer cover the Al—Si particles, so this invites oxidation of the Al—Si particles. Further, it is also conceivable that the Al—Si particles obstruct the firing of the aluminum paste.

Therefore, if the amount of the Al—Si particles added is increased, the resistance of the electrode surface can be reduced but if too much Al—Si particles are added, conversely an increase in the resistance of the electrode surface is caused. Thus, the addition of a certain amount of low resistance particles is believed to reduce the surface resistance. That is, judging from the results of the surface resistance with respect to amounts of addition of Al—Si particles in this example, the resistance of the electrode surface can be reduced if the amount of the Al—Si particles added is from 4 to 50% by weight.

Example 6

Figure 10:
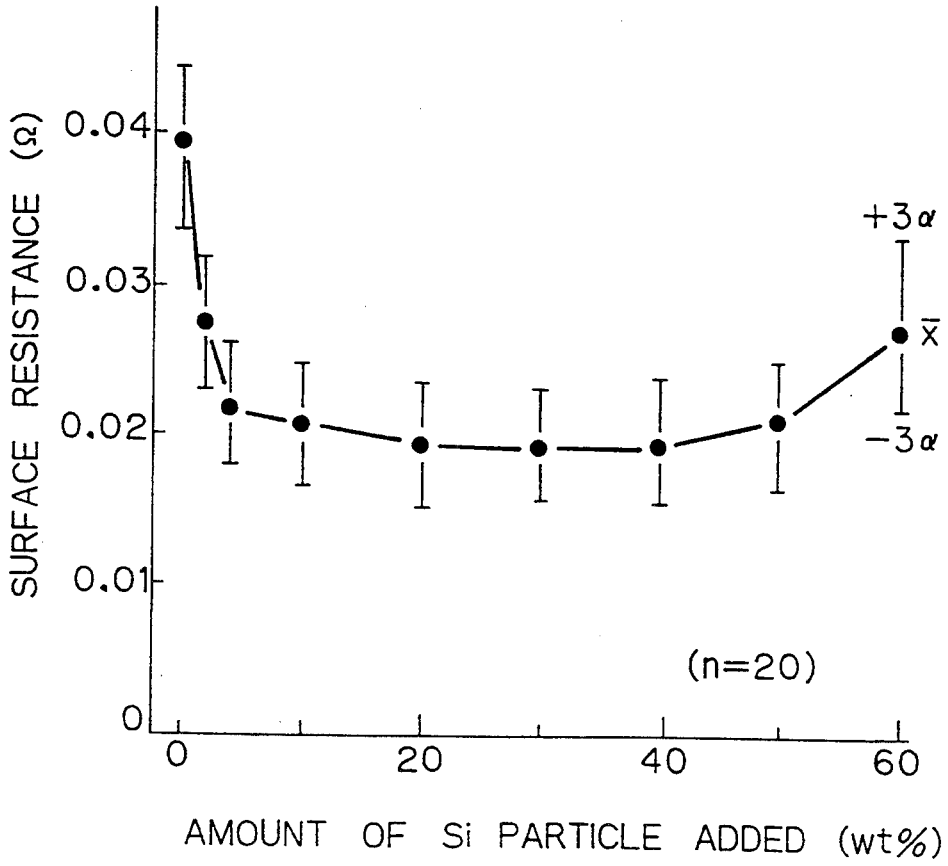
FIG. 10 is a characteristic diagram showing the changes in the surface resistance with respect to the changes in the amount of the Si particles added, and FIGS. 11(*a*), (*b*) and (*c*) are constitutional view of Example 8.

In Example 5, metal particles of Al—Si particles were added to an aluminum paste containing lead borosilicate glass frit. In Example 6, nonmetallic particles of Si particles were added instead of the Al—Si particles. The Si particles (specific resistance of 10 μΩcm) had the same size as the Al—Si particles and the same method was used for the production and evaluation as Example 5. The results are shown in Table 2. FIG. 10 shows the changes in the surface resistance with respect to changes in the amount of Si particles added.

TABLE 2

| | No. | Material | Amount added (wt %) | Surface resistance (Ω) | Judgment | Specific resistance (μΩ cm) |
|---|---|---|---|---|---|---|
| Ex. 6 | 11 | Si | 15 | 0.020 | ○ | 10 |
| | 10 | Si | 0 | 0.039 | x | 10 |
| | 13 | Si | 2 | 0.029 | x | 10 |
| | 14 | Si | 4 | 0.022 | ○ | 10 |
| | 15 | Si | 10 | 0.021 | ○ | 10 |
| | 16 | Si | 20 | 0.019 | ○ | 10 |
| | 17 | Si | 30 | 0.019 | ○ | 10 |
| | 18 | Si | 40 | 0.019 | ○ | 10 |
| | 19 | Si | 50 | 0.021 | ○ | 10 |
| | 20 | Si | 60 | 0.028 | x | 10 |

As shown in FIG. 10, the surface resistance falls with 0 to 30% by weight of Si particles added. When the amount added exceeds 50% by weight, the surface resistance increases. This is the same characteristic as shown with the addition of the metal particles of Al—Si. From the above results, it is clear that not only metal particles of Al—Si, but also nonmetallic particles of Si may be added to the aluminum paste containing the lead borosilicate glass frit.

Example 7

Tables 3 and 4 show the results of evaluation of Example 7. The process of production, method of evaluation, and particle size were the same as in Example 5. The materials of the low resistance particles added are shown below.

No. 21 to 38:15% by weight of other metal particles added

No. 39 to 41:15% by weight of silicides added

No. 42 to 46:15% by weight of borides added

No. 47 to 48:15% by weight of nitrides added

No. 49 to 52:15% by weight of carbides added

No. 53 to 57:15% by weight of oxides added

TABLE 3

| No. | Material | Amount added (wt %) | Surface resistance (Ω) | Judgment | Specific resistance (μΩ cm) |
|---|---|---|---|---|---|
| 21 | Al | 15 | 0.021 | ○ | 2.7 |
| 22 | Al-Cu | 15 | 0.020 | ○ | 2.2 |
| 23 | Al-Mg | 15 | 0.021 | ○ | 6.2 |
| 25 | Ag | 15 | 0.019 | ○ | 1.6 |
| 26 | Au | 15 | 0.020 | ○ | 2.4 |
| 27 | Pt | 15 | 0.021 | ○ | 10.6 |
| 28 | Pd | 15 | 0.021 | ○ | 10.8 |
| 29 | Cu | 15 | 0.019 | ○ | 1.7 |
| 30 | Cu-Zn | 15 | 0.021 | ○ | 6.2 |
| 31 | Fe | 15 | 0.020 | ○ | 9.7 |
| 32 | Co | 15 | 0.020 | ○ | 6.2 |
| 33 | Ni | 15 | 0.020 | ○ | 6.8 |
| 34 | Ti | 15 | 0.020 | ○ | 4.2 |
| 35 | W | 15 | 0.020 | ○ | 5.7 |
| 36 | Mo | 15 | 0.019 | ○ | 5.2 |
| 37 | Mg | 15 | 0.021 | ○ | 4.5 |
| 38 | Ru | 15 | 0.020 | ○ | 7.6 |

TABLE 4

| No. | Material | Amount added (wt %) | Surface resistance (Ω) | Judgment | Specific resistance (μΩ cm) |
|---|---|---|---|---|---|
| 39 | $TiSi_2$ | 15 | 0.020 | ○ | 17 |
| 40 | $MoSi_2$ | 15 | 0.020 | ○ | 22 |
| 41 | $WSi_2$ | 15 | 0.019 | ○ | 12.5 |
| 42 | $TiB_2$ | 15 | 0.021 | ○ | 9.0 |
| 43 | $Mo_2B_5$ | 15 | 0.021 | ○ | 26 |

TABLE 4-continued

| No. | Material | Amount added (wt %) | Surface resistance (Ω) | Judgment | Specific resistance (μΩ cm) |
|---|---|---|---|---|---|
| 44 | $W_2B_5$ | 15 | 0.020 | ○ | 22 |
| 45 | ZrB | 15 | 0.020 | ○ | 9.7 |
| 46 | $LaB_6$ | 15 | 0.021 | ○ | 15 |
| 47 | TiN | 15 | 0.021 | ○ | 40 |
| 48 | ZrN | 15 | 0.021 | ○ | 18 |
| 49 | TiC | 15 | 0.020 | ○ | 61 |
| 50 | WC | 15 | 0.021 | ○ | 19 |
| 51 | ZrC | 15 | 0.020 | ○ | 49 |
| 52 | TaC | 15 | 0.021 | ○ | 22 |
| 53 | ZnO | 15 | 0.020 | ○ | 60 |
| 54 | $RuO_2$ | 15 | 0.021 | ○ | 40 |
| 55 | $ReO_2$ | 15 | 0.021 | ○ | 50 |
| 56 | $VO_2$ | 15 | 0.020 | ○ | 80 |
| 57 | $MoO_2$ | 15 | 0.020 | ○ | 70 |

Even when viewing the results of the evaluation of this example, it is clear that excellent resistance of the electrode surface is displayed if low resistance particles are added to the aluminum paste containing lead borosilicate glass frit. Any particles are believed acceptable so long as they are low resistance.

Further, it is judged from the specific resistances of the materials that the specific resistance of the low resistance particles should be 100 μΩcm or less.

Example 8

In the above Examples 1 to 3, the first electrode and the second electrode were bonded by an electrically insulative adhesive, but the present invention is not limited to this.

Figure 11A:
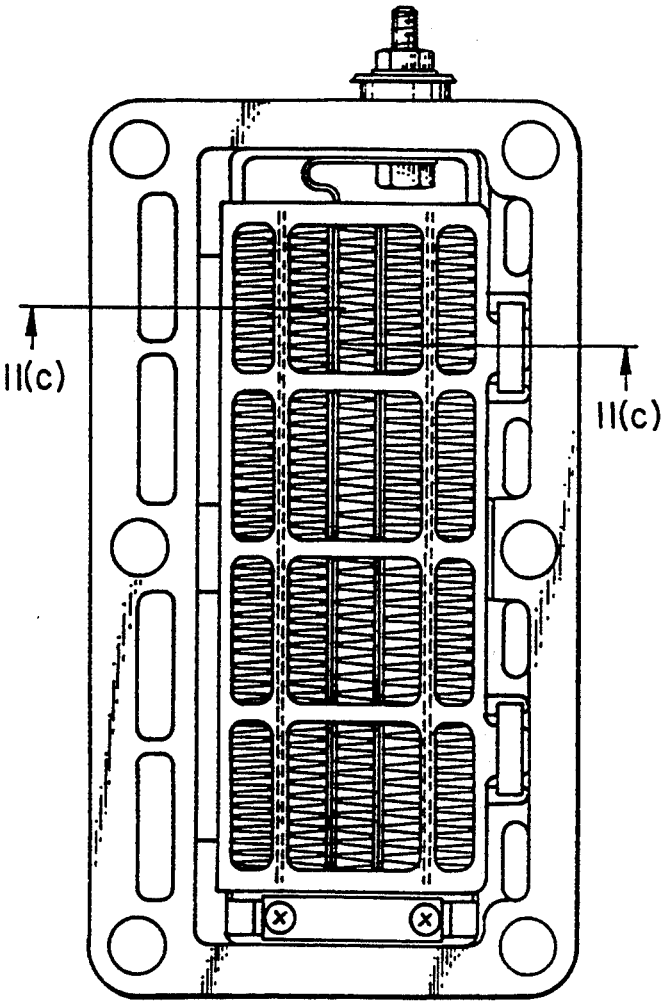
Figure 11B:
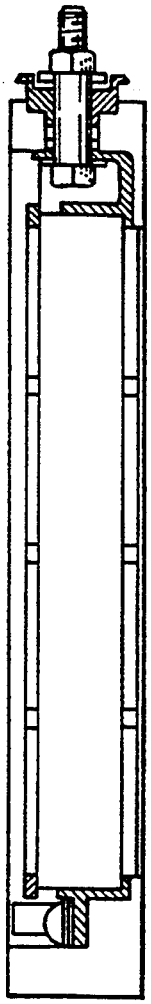
Figure 11C:
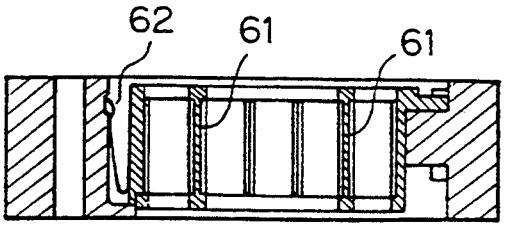

That is, for example, when the positive-temperature-coefficient thermistor heating device 61 of the present invention is used for an intake heater, it may be made the structure shown in FIGS. 11(*a*), (*b*) and (*c*).

That is, the first electrode and the second electrode may be made to contact each other by a means 62 for applying pressure from the outside of the positive-temperature-coefficient thermistor heating device 61, e.g., a spring 62.

We claim:

1. A positive-temperature-coefficient thermistor heating device comprising:

a PTC element, a first single layered electrode formed on the surface of the PTC element, a heat radiating means having heat radiating fins and a second electrode, and conductive particles contained in the first electrode and providing a rough surface on the first electrode and electrically conducted to the second electrode, said first electrode and said second electrode being bonded by an electrically insulative adhesive.

2. A positive-temperature-coefficient thermistor heating device as claimed in claim 1, wherein the surface roughness of the rough surface formed on the said first electrode is 20 to 120 μm.

3. A positive-temperature-coefficient thermistor heating device comprising:

a PTC element, a first electrode formed on the surface of the PTC element, which is a single layered ohmic electrode composed of aluminum paste containing glass frit comprised mainly of lead borosilicate, and conductive particles having a specific resistance of not more than 100 μΩcm contained in said first electrode in an amount of 4 to 50% by weight.

4. A positive-temperature-coefficient thermistor heating device comprising:

a PTC element, a first electrode formed on the said PTC element, comprised of aluminum paste containing glass frit mainly comprised of lead borosilicate and conductive particles, and given a rough surface by said conductive particles, a second electrode electrically conductive to the rough surface of said first electrode and having heat radiating fins, and an electrically insulative adhesive for bonding said first electrode and said second electrode, said conductive particles having a specific resistance of not more than 100 μΩcm and a size of 30 to 150 μm.

5. A positive-temperature-coefficient thermistor heating device as claimed in claim 4, wherein the irregular surface of the said first electrode has a surface roughness of 20 to 120 μm and the conductive particles comprise 4 to 50% by weight of at least one of Si and Al—Si alloy.

6. A process for production of a positive-temperature-coefficient thermistor heating device, comprising the steps of printing an electrode material paste containing conductive particles on the surface of a PTC element, heating this to bake it on and form a first electrode having a rough surface, and bringing the first electrode and the second electrode of the heat radiating means into contact by the conductive particles, said electrode material paste comprising aluminum powder and lead borosilicate and said conductive particles having an average particle size larger than that of the aluminum powder and a specific resistance of not more than 100 μΩcm.

7. A process for production of a positive-temperature-coefficient thermistor heating device as claimed in claim 6, wherein an electrically insulative adhesive is interposed between said first electrode and said second electrode in the state with the said conductive particles and second electrode in contact and the size of the conductive particles is 30 to 150 μm and the amount of the conductive particles added is 4–50% by weight.

* * * * *